United States Patent [19]

Parissis et al.

[11] Patent Number: 4,950,359

[45] Date of Patent: Aug. 21, 1990

[54] PROCESS FOR REMOVING A COATING CONTAINING NIOBIUM FROM A SUBSTRATE

[75] Inventors: Gérard Parissis, Brussels; Lucien Clerbois, Vilvoorde, both of Belgium

[73] Assignee: Solvay & Cie (Societe Anonyme), Brussels, Belgium

[21] Appl. No.: 396,754

[22] Filed: Aug. 17, 1989

Related U.S. Application Data

[63] Continuation of Ser. No. 929,849, Nov. 13, 1986, abandoned.

[30] Foreign Application Priority Data

Jul. 25, 1986 [FR] France ..... 86 11001

[51] Int. Cl.[5] ..... H01L 21/306

[52] U.S. Cl. ..... 156/627; 156/640; 156/656; 156/664; 252/79.5; 204/32.1; 204/35.1; 204/146; 423/62; 423/68; 427/352; 134/2; 134/1; 134/42

[58] Field of Search ..... 204/32.1, 35.1, 146; 423/62, 68, 592, 272; 134/2, 42; 252/79.5; 75/101 R, 121; 156/627, 634, 640, 656, 664; 427/347, 352

[56] References Cited

U.S. PATENT DOCUMENTS

| | | | |
|---|---|---|---|
| 1,999,807 | 4/1935 | Gibbs | 423/68 |
| 3,394,063 | 7/1968 | Blume | 204/146 |
| 3,492,210 | 1/1970 | Bowers | 204/146 |
| 4,304,762 | 12/1981 | Leigh | 423/272 |
| 4,495,158 | 1/1985 | Ritsko et al. | 423/62 |
| 4,497,725 | 5/1985 | Smith et al. | 423/272 |

FOREIGN PATENT DOCUMENTS

| | | |
|---|---|---|
| 0009839 | 4/1980 | European Pat. Off. . |
| 2239425 | 2/1974 | Fed. Rep. of Germany . |
| 2150383 | 6/1973 | France . |
| 2195701 | 8/1974 | France . |

OTHER PUBLICATIONS

Mellor, J. W., *Inorganic and Theoretical Chemistry*, vol. IX, (1949), p. 816.

Horiba, Tatsuo et al., "Acidic-Electrolyte Fuel Cell", Patent Abstracts of Japan, vol. 5, No. 99 (56-42966), 6/26/81.

Grossman, J. et al., "A New Etchant for Thin Films of Tantalum and Tantalum Compounds", *J. of the Electrochemical Soc.*, v. 116, No. 5, May, 1969, p. 674.

Meller, J. W., *Inorganic and Theoretical Chemistry*, v. IX, (1954), pp. 849-862.

Basic Abstracts Journal, Section L, Week D. 19, Derwent Publications Ltd., London, abstract 33525D-L: Patent Application JP-A-56-029, 324 (Tokyo Shibaura Elec. Ltd.).

*Primary Examiner*—Robert L. Stoll

*Attorney, Agent, or Firm*—Spencer & Frank

[57] ABSTRACT

Cleaning baths for the removal of a coating containing niobium on a substrate, consisting of an aqueous solution of hydrogen peroxide and of alkali metal hydroxide. The coating is treated with the bath, to remove it from the substrate by dissolving.

19 Claims, No Drawings

PROCESS FOR REMOVING A COATING CONTAINING NIOBIUM FROM A SUBSTRATE

This application is a continuation of application Ser. No. 6/929,849, filed Nov. 13th, 1986, now abandoned.

BACKGROUND OF THE INVENTION

Field of the Invention

The present invention relates to cleaning baths and to a process for removing a coating containing niobium from a substrate.

Niobium and niobium alloys are known for their advantageous chemical and electrical properties, especially their corrosion resistance towards the majority of corrosive substances at ambient temperature and, above all, their properties of being an excellent conductor of heat and of electricity. As a result of this, niobium and it alloys are frequently used for the construction of chemical engineering plants and equipment and also as a superconductive coating for electrodes. It is known, in fact, that the electrical resistivity of niobium and its alloys becomes virtually zero below 8.3K (Revue de la Société Royale Belge des Ingénieurs et des industriels, No. 8/9, 1969: R. Winand, "Propriétés et usages des métaux réfractaires" ["Properties and uses of refractory metals"], pages 381 to 415). However, the high price of niobium often causes it to be used in the form of a coating on a substrate (R. Lescarts—Dictionnaire des métaux non ferreux [Dictionary of nonferrous metals], 1972, p. 107).

In the construction or maintenance of electrodes or other components bearing a coating containing niobium it may be necessary to dissolve or to clean off the coating in order to release the substrate completely or in part.

In order to accomplish the removal of the niobium, it has been proposed to use, at a temperature below 50° C., a cleaning solution containing 45 to 65 parts by volume of water, 30 to 50 parts by volume of concentrated sulphuric acid, 0.2 to 3.0 parts by volume of a concentrated aqueous solution of hydrogen peroxide and 1.0 to 5.0 parts by volume of concentrated hydrofluoric acid (Central Patents Index, Basic Abstracts Journal, Section L, Week D. 19, Derwent Publications Ltd., London, abstracts 33525D-L: Patent Application JP-A-56-029,324 (Tokyo Shibaura Elec. Ltd)). The cleaning performed in this way is generally quick and efficient, but the presence of hydrofluoric acid makes these known baths toxic and hazardous for users and, consequently, gives rise to polluting wastes. Furthermore, these baths are inadvisable in the case of a copper substrate which is liable to be corroded by them.

SUMMARY OF THE INVENTION

Accordingly, the invention is aimed at providing a cleaning bath enabling a coating containing niobium and a substrate to be quickly and efficiently removed without giving rise to polluting and toxic wastes and, above all, without damaging the substrate, especially when the latter is made of copper.

Consequently, the invention relates to baths for removing a coating containing niobium from a substrate, which consist of an aqueous solution of an alkali metal hydroxide and of hydrogen peroxide.

In the baths according to the invention, the alkali metal hydroxide may be, for example, sodium hydroxide or potassium hydroxide. Sodium hydroxide is preferred.

The concentrations of alkali metal hydroxide and of hydrogen peroxide in the baths according to the invention depend on various factors, especially on the temperature at which they are used, on the desired rate of attack, on the thickness of the coating to be removed and on the substrate material. In practice it is generally appropriate that the baths according to the invention contain, per liter, at least 0.4 mole of alkali metal hydroxide and at least 7.5 ml of 100% hydrogen peroxide. Examples of baths which can be used in the process according to the invention are those containing, per liter, between 0.5 and 4 moles of alkali metal hydroxide and between 10 and 155 ml of 100% hydrogen peroxide. The preferred baths are those containing, per liter, between 0.5 to 2 moles of alkali metal hydroxide and between 13 to 75 ml of 100% hydrogen peroxide.

The aqueous solution of the baths according to the invention may advantageously contain, in usual proportions, a hydrogen peroxide stabilizer such as a gluconic acid derivative or a phosphonic acid derivative, for example one of the products known under the trademark "Dequest" (Monsanto), which are phosphonic acid derivatives. If desired, it may contain additives which are commonly present in metal-cleaning baths, such as, for example, surface-active agents and corrosion inhibitors.

The cleaning baths according to the invention are suitable for removing a coating containing niobium on all kinds of substrates which do not run the risk of being subject to localized corrosion in contact with the said baths. They are particularly suitable for the removal of a coating containing niobium on a substrate made of copper or of a copper-based alloy. The coating may be pure niobium or a niobium alloy, for example a Nb-C-N alloy or a Nb-Al-Ge alloy or alternatively a Nb-Ti alloy.

The invention accordingly also relates to a process for removing a coating containing niobium on a substrate, by treating the coating with a cleaning bath according to the invention. In the process according to the invention, the treatment of the coating using the bath may be performed by means of any suitable method, for example by immersing the substrate with its coating in the bath, or by coating or spraying the bath onto the coating.

The quantity of the bath employed must be sufficient to dissolve the niobium coating. It depends in particular on the mass of the coating to be removed, on its constitution, on the composition of the bath and on the temperature. It must be determined in each case.

The process according to the invention is appropriately carried out at a temperature at which there is no risk of an untimely decomposition of the bath. To this end it is generally convenient to use the bath at a temperature which does not exceed 50° C., an ambient temperature of between 15° and 25° C. being the most suitable in the majority of cases.

In the process according to the invention, it is important that it should be possible to follow the progress of the process of removal of the coating from the substrate, so as to determine accurately the suitable time for stopping the bath treatment. To this end, in an advantageous embodiment of the process according to the invention, the end of the reaction between the bath and the coating is detected by measuring the electrochemical potential of the substrate in the bath. In implementing this embodiment of the process, it is accordingly sufficient to couple a cell measuring the potential between the substrate together with its coating, with a reference electrode which is immersed in the bath.

The process according to the invention finds an application, in particular, in the construction and maintenance of particle accelerators such as, for example, cyclotrons, where it may be employed to remove a super-conducting coating of niobium or of niobium alloy from the copper wall of the cavities forming the electrodes supplied with high-frequency current (for example, an alloy of niobium and titanium, as suggested in the document Research and Development, January 1986, pages 49 and 50: "Physics-Magnet design brings breath of reality to SSC").

DESCRIPTION OF THE PREFERRED EMBODIMENTS

The advantage of the invention will become apparent from the examples which are described below.

These examples relate to tests in which copper panels bearing a niobium coating have been treated in accordance with the process according to the invention to remove the niobium coating.

Three tests were carried out with baths according to the invention, whose composition is given in Table I.

TABLE 1

| | Bath composition | | |
|---|---|---|---|
| Test No. | NaOH (mole/l) | $H_2O_2$ (100%) (ml/l) | Stabilizer: 50% DTPMP (*) (ml/l) |
| 1 | 1 | 76 | 2.5 |
| 2 | 1 | 38 | 0 |
| 3 | 0.5 | 25 | 2.5 |

(*) Diethylenetriaminepenta(methylenephosphonic acid)

In each test, a panel was immersed in the bath at ambient temperature and the niobium removal process was followed by measuring the electrochemical potential of the panel relative to a KCl-saturated calomel reference electrode. The weight of niobium removed was determined by measuring the weight of the panel, before and after the treatment, respectively; the surface area of the panel being known, the thickness of the niobium film removed was deduced.

The results of the tests are listed in Table II.

TABLE II

| | Duration of | Panel potential | | Nb film removed |
|---|---|---|---|---|
| Test No. | the treatment (min) | Initial (mV) | Final (mV) | Thickness (μm) |
| 1 | 10 | −210 | +25 | 1.6 |
| 2 | 18 | −250 | −3 | 0.46 |
| 3 | 51 | −380 | −8 | 0.74 |

The panels collected at the end of the tests were found to be completely free from their niobium coating. They had a uniformly polished surface, free from any corrosion areas.

We claim:

1. A process for removing at least a part of a coating consisting of metallic niobium or a niobium alloy from a substrate, the process comprising:

dissolving at least a part of the coating by treatment thereof with a cleaning bath which is an aqueous solution comprised of hydrogen peroxide and an alkali metal hydroxide.

2. The process according to claim 1, wherein the alkali metal hydroxide is sodium hydroxide.

3. The process according to claim 1, wherein the aqueous solution comprises, per liter, at least 7.5 ml of hydrogen peroxide and at least 0.4 mole of alkali metal hydroxide.

4. The process according to claim 1, wherein the aqueous solution comprises, per liter, between 13 and 75 ml of hydrogen peroxide and between 0.5 and 2 moles of alkali metal hydroxide.

5. The process according to claim 1, wherein the aqueous solution further comprises a stabilizer for stabilizing the hydrogen peroxide contained in the aqueous solution, which stabilizer is at least one phosphonic acid derivatve.

6. The process according to claim 1, wherein the aqueous solution further comprises a stabilizer for stabilizing the hydrogen peroxide contained in the aqueous solution, which stabilizer is diethylenetriaminepenta(-methylenephosphonic acid).

7. The process according to claim 1, wherein the cleaning bath is maintained at a temperature of between 15° and 25° C. during the dissolution.

8. The process according to claim 1, wherein the substrate is made of copper or copper alloy.

9. The process according to claim 1, comprising the further step of detecting complete dissolution of the coating being removed with the cleaning bath by measuring the electrochemical potential between the substrate with the coating and a reference electrode, which substrate and reference electrode are immersed in the cleaning bath, by observing the change in the electrochemical potential.

10. The process according to claim 1, wherein the coating is treated by immersing the coating in the coating bath.

11. The process according to claim 1, wherein the coating is treated by spraying the cleaning bath onto the coating.

12. The process according to claim 1, wherein the coating is treated by coating the cleaning bath onto the coating.

13. A process for removing at least part of a coating consisting of metallic niobium or a niobium alloy from a substrate comprised of copper or a copper alloy, the process comprising:

dissolving at least a part of the coating by treatment thereof with a cleaning bath which is an aqueous solution comprised of:

from 10 to 155 ml per liter of hydrogen peroxide; and from 0.5 to 4 moles per liter of an alkali metal hydroxide.

14. The process according to claim 13, comprising the further step of detecting complete dissolution of the coating being removed with the cleaning bath by measuring the electrochemical potential between the substrate with the coating and a reference electrode, which substrate and reference electrode are immersed in the coating bath, by observing the change in the electrochemical potential.

15. The process according to claim 13, wherein the cleaning bath is maintained at a temperature of between 15° and 25° C. during dissolution.

16. The process according to claim 13, wherein the aqueous solution comprises, per liter, at least 7.5 ml of hydrogen peroxide and at least 0.4 mole of alkali metal hydroxide.

17. The process according to claim 13, wherein the aqueous solution comprises between 13 and 75 ml of hydrogen peroxide and between 0.5 to 2 moles per liter of alkali metal hydroxide.

18. The process according to claim 13, wherein the alkali metal hydroxide is sodium hydroxide.

19. The process according to claim 13, wherein the coating is dissolved by treatment thereof by one of immersing the coating in the coating bath, spraying the coating bath onto the coating, and coating the cleaning bath onto the coating.

* * * * *